US010565908B2

(12) United States Patent
Lee

(10) Patent No.: US 10,565,908 B2
(45) Date of Patent: Feb. 18, 2020

(54) DISPLAY DEVICE AND METHOD OF COMPENSATING DEGRADATION

(71) Applicant: Samsung Display Co., Ltd., Yongin-si, Gyeonggi-do (KR)

(72) Inventor: Wook Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 185 days.

(21) Appl. No.: 15/357,856

(22) Filed: Nov. 21, 2016

(65) Prior Publication Data

US 2017/0249882 A1 Aug. 31, 2017

(30) Foreign Application Priority Data

Feb. 29, 2016 (KR) ..... 10-2016-0024621

(51) Int. Cl.

| | |
|---|---|
| ***G09G 3/00*** | (2006.01) |
| ***G09G 3/3266*** | (2016.01) |
| ***G09G 3/3275*** | (2016.01) |
| ***G09G 3/3233*** | (2016.01) |

(52) U.S. Cl.

CPC ..... *G09G 3/006* (2013.01); *G09G 3/3233* (2013.01); *G09G 3/3266* (2013.01); *G09G 3/3275* (2013.01); *G09G 2310/08* (2013.01); *G09G 2320/045* (2013.01); *G09G 2320/048* (2013.01); *G09G 2330/10* (2013.01)

(58) Field of Classification Search

CPC ... G09G 2300/0819; G09G 2300/0861; G09G 2310/0251; G09G 2310/0262; G09G 2310/08; G09G 2320/0295; G09G 2320/043; G09G 2320/045; G09G 2320/048; G09G 2330/10; G09G 3/006; G09G 3/3233; G09G 3/3241; G09G 3/3266; G09G 3/3275

See application file for complete search history.

(56) References Cited

U.S. PATENT DOCUMENTS

| | | | | |
|---|---|---|---|---|
| 9,721,502 | B2 * | 8/2017 | Bi | G09G 3/3233 |
| 2005/0285822 | A1 * | 12/2005 | Reddy | G06F 3/03542 345/76 |
| 2011/0191042 | A1 | 8/2011 | Chaji et al. | |
| 2015/0294626 | A1 * | 10/2015 | Bi | G09G 3/3233 345/211 |

* cited by examiner

*Primary Examiner* — Afroza Chowdhury
(74) *Attorney, Agent, or Firm* — Lewis Roca Rothgerber Christie LLP

(57) ABSTRACT

A display device includes a display panel including a pixel electrically connected to a feedback line, a sensor electrically connected to the feedback line, the sensor being configured to measure an impedance of the pixel in response to a first control signal, and to measure a driving current flowing through the pixel in response to a second control signal, and a timing controller configured to selectively generate the first control signal and the second control signal based on an aging time of the display panel.

17 Claims, 8 Drawing Sheets

DISPLAY DEVICE AND METHOD OF COMPENSATING DEGRADATION

CROSS-REFERENCE TO RELATED APPLICATION

This application claims priority to, and the benefit of, Korean Patent Application No. 10-2016-0024621, filed on Feb. 29, 2016 in the Korean Intellectual Property Office (KIPO), the content of which is incorporated herein in its entirety by reference.

BACKGROUND

1. Field

Aspects of the present inventive concept relate to a display device and a method of driving the same.

2. Description of the Related Art

An organic light emitting display device displays an image using an organic light emitting diode. The organic light emitting diode and/or a driving transistor that transfers a current to the organic light emitting diode may be degraded as the organic light emitting diode and/or the driving transistor operates. The organic light emitting display device may not display an image with desired luminance due to degradation of the organic light emitting diode and/or degradation of the driving transistor (such degradation also being referred to as "pixel degradation").

A conventional organic light emitting display device provides a reference voltage to pixels, measures a current (or a driving current) flowing through each of the pixels in response to the reference voltage, and calculates an amount of pixel degradation based on a change of the current. However, a variation characteristic of the current is unstable in an initial state when the stress applied to the pixels is relatively low (e.g., an aging time of the display device is within hundreds of hours). That is, the amount or degree of pixel degradation is not linearly tied to the change of current, and so the conventional organic light emitting display device may not be able to accurately calculate the amount of pixel degradation based on the change of current. Therefore, the pixel degradation may be inaccurately compensated.

SUMMARY

Aspects of embodiments of the present inventive concept are directed to a display device that can accurately compensate pixel degradation in an initial state when stress applied to the display device is relatively low.

Aspects of embodiments of the present inventive concept are directed to a method of compensating degradation that is performed by the display device.

According to example embodiments of the present inventive concept, there is provided a display device including: a display panel including a pixel electrically connected to a feedback line; a sensor electrically connected to the feedback line, the sensor being configured to measure an impedance of the pixel in response to a first control signal, and to measure a driving current flowing through the pixel in response to a second control signal; and a timing controller configured to selectively generate the first control signal and the second control signal based on an aging time of the display panel.

In an embodiment, the sensor is further configured to provide a first reference voltage to the feedback line in response to the first control signal, and to measure the impedance of the pixel by integrating a first current that is fed back through the feedback line according to the first reference voltage, and wherein the first reference voltage is lower than, or equal to, a threshold voltage of an organic light emitting diode of the pixel.

In an embodiment, the sensor is further configured to discharge a parasitic capacitor of the organic light emitting diode by providing a low power voltage to the feedback line before the first reference voltage is provided to the feedback line.

In an embodiment, the sensor is further configured to provide a second reference voltage to the feedback line in response to the second control signal, and to measure the driving current by integrating a second current that is fed back through the feedback line according to the second reference voltage, and wherein the second reference voltage is greater than, or equal to, a threshold voltage of an organic light emitting diode of the pixel.

In an embodiment, the timing controller is further for determining when the aging time exceeds a reference time, for generating the first control signal when the aging time is less than the reference time, and for generating the second control signal when the aging time is greater than the reference time.

In an embodiment, the pixel includes: an organic light emitting diode including a cathode electrically connected to a low power voltage; and a sensing transistor electrically connected between an anode of the organic light emitting diode and the feedback line.

In an embodiment, the sensor includes: an amplifier including: a first input terminal electrically connected to the feedback line; a second input terminal configured to receive a reference voltage; and an output terminal; a capacitor electrically connected between the first input terminal of the amplifier and the output terminal of the amplifier;

and a switch electrically connected in parallel to the capacitor, the switch being configured to be turned off based on a switch control signal.

In an embodiment, the first control signal includes a first sensing control signal to control the sensing transistor, and to control a first switch control signal to control the switch, the first sensing control signal has a first turn-on voltage to turn on the sensing transistor in a first sensing period, and the first switch control signal has a second turn-off voltage to turn off the switch in the first sensing period.

In an embodiment, the second control signal includes a second sensing control signal to control the sensing transistor, and a second switch control signal to control the switch, wherein the second sensing control signal has the first turn-on voltage in a second sensing period, wherein the second switch control signal has a second turn-on voltage to turn on the switch in a reset period, and has the second turn-off voltage in an integration period, and wherein the second sensing period includes the reset period and the integration period.

In an embodiment, the timing controller is configured to calculate an amount of pixel degradation of the pixel based on the impedance of the pixel or the driving current.

In an embodiment, the timing controller is configured to calculate an impedance variation based on the impedance, and to obtain the amount of pixel degradation corresponding to the impedance variation by using a first degradation curve that represents a correlation between the impedance variation and the amount of pixel degradation.

According to example embodiments of the present inventive concept, there is provided a display device including: a display panel including a pixel electrically connected to a feedback line; a sensor electrically connected to the feedback line, the sensor being configured to measure an impedance of the pixel in response to a first control signal, and to measure a driving current flowing through the pixel in response to a second control signal; and a timing controller configured to selectively generate the first control signal and the second control signal based on input data that includes a grayscale value corresponding to the pixel.

In an embodiment, the timing controller is configured to determine when the input data exceeds a reference grayscale value, to generate the first control signal when the input data is less than, or equal to, the reference grayscale value, and to generate the second control signal when the input data is greater than the reference grayscale value.

According to example embodiments of the present inventive concept, there is provided a method of compensating degradation, the method including: determining when an aging time of a display panel exceeds a reference time, the display panel including a pixel electrically connected to a feedback line; and measuring an impedance of the pixel when the aging time is less than the reference time.

In an embodiment, measuring the impedance of the pixel includes discharging a parasitic capacitor of an organic light emitting diode of the pixel by providing a low power voltage to the feedback line.

In an embodiment, measuring the impedance of the pixel further includes: providing a first reference voltage to the feedback line; and integrating a first current that is fed back through the feedback line according to the first reference voltage, and the first reference voltage is lower than, or equal to, a threshold voltage of the organic light emitting diode.

In an embodiment, the method further includes measuring a driving current flowing through the pixel when the aging time is greater than the reference time.

In an embodiment, measuring the driving current includes: providing a second reference voltage to the feedback line; and integrating a second current that is fed back through the feedback line according to the second reference voltage, and wherein the second reference voltage is higher than, or equal to, a threshold voltage of an organic light emitting diode of the pixel.

In an embodiment, the method further includes calculating an amount of pixel degradation of the pixel based on the impedance of the pixel or the driving current.

In an embodiment, calculating the amount of pixel degradation includes: calculating an impedance variation based on the impedance; and obtaining the amount of pixel degradation corresponding to the impedance variation by using a first degradation curve that represents a correlation between the impedance variation and the amount of pixel degradation.

Therefore, a display device according to example embodiments may improve (e.g., increase) accuracy of degradation compensation (or compensation of pixel degradation) by measuring one of an impedance of a pixel and a driving current flowing through the pixel based on a driving condition of the display device (e.g., based on an aging time of a display panel, or based on input data), and by calculating an amount of pixel degradation of the pixel based on the impedance of the pixel or the driving current. For example, the display device may improve accuracy of degradation compensation by calculating the amount of pixel degradation based on an impedance variation of the pixel, as opposed to calculating the amount of pixel degradation based on a current variation when stress applied to the display device is relatively low (e.g., at an initial state of the display device), and as opposed to calculating the amount of pixel degradation based on when a grayscale value in the input data is relatively low (e.g., when a low grayscale value is provided to the pixel).

In addition, a method of compensating degradation (or a pixel degradation) according to example embodiments may effectively drive the display device.

BRIEF DESCRIPTION OF THE DRAWINGS

Illustrative, non-limiting example embodiments will be more clearly understood from the following detailed description taken in conjunction with the accompanying drawings.

DESCRIPTION OF EMBODIMENTS

Hereinafter, the present inventive concept will be explained in further detail with reference to the accompanying drawings.

Figure 1:
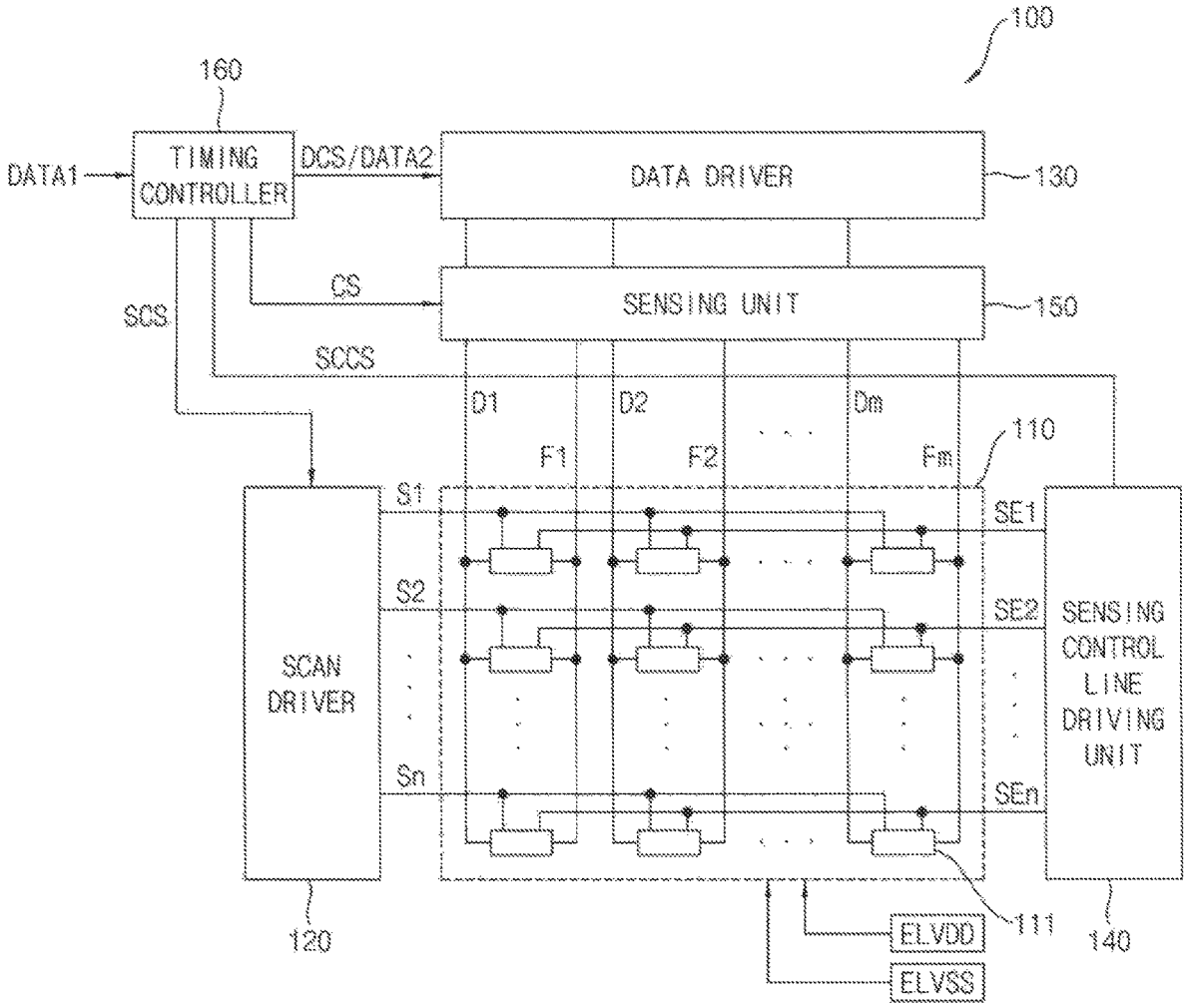
FIG. 1 is a block diagram illustrating a display device according to example embodiments of the present inventive concept.

FIG. 1 is a block diagram illustrating a display device according to example embodiments of the present inventive concept.

Referring to FIG. 1, the display device 100 may include a display panel 110, a scan driver 120, a data driver 130, a sensing control line driving unit 140 (or a sensing control line driver), a sensing unit 150 (or sensor), and a timing controller 160. The display device 100 may display an image based on image data provided from an external device. For example, the display device 100 may be an organic light emitting display device.

The display panel 110 may include scan lines S1 through Sn, data lines D1 through Dm, sensing control lines SE1 through SEn, feedback lines F1 through Fm, and pixels 111, where each of m and n is an integer that is greater than or equal to 2. The pixels 111 may be respectively located at crossing regions of the scan lines S1 through Sn, the data lines D1 through Dm, the sensing control lines SE1 through SEn, and the feedback lines F1 through Fm.

Each of the pixels 111 may store a data signal in response to a scan signal, and may emit light based on the stored data signal. A configuration of the pixels 111 will be described in further detail with reference to FIG. 3.

The scan driver 120 may generate the scan signal based on a scan driving control signal SCS. The scan driving control signal SCS may be provided from the timing controller 160 to the scan driver 120. The scan driving control signal SCS may include a start pulse and clock signals, and the scan driver 120 may include a shift register for sequentially generating the scan signal based on the start pulse and the clock signals.

The data driver 130 may generate the data signal based on a data driving control signal DCS and image data (e.g., second data DATA2). The data driver 130 may provide the display panel 110 with the data signal generated in response to the data driving control signal DCS. That is, the data driver 130 may provide the data signal to the pixels 111 through the data lines D1 through Dm. The data driving control signal DCS may be provided from the timing controller 160 to the data driver 130.

The sensing control line driving unit 140 may generate a sensing control signal in response to a sensing control line driving control signal SCCS. The sensing control line driving control signal SCCS may be provided from the timing controller 160 to the sensing control line driving unit 140, and the sensing control signal may be provided to a sensing transistor included in each of the pixels 111.

The sensing unit 150 may be electrically connected to the feedback lines F1 through Fm, and may measure (or sense, detect) an impedance of each of the pixels 111 (or an impedance of a pixel) and a driving current flowing through each of the pixels 111 (or a driving current of a pixel) based on a control signal CS. Here, the control signal Cs may be provided from the timing controller 160 to the sensing unit 150. The impedance of the pixel may be an impedance of an organic light emitting diode included in the pixel, and may include a resistance and a capacitance (e.g., a parasitic capacitance of the organic light emitting diode). Because the resistance is significantly less than the impedance, the resistance may not be considered to be part of the impedance of the pixel. That is, it may be assumed that the impedance of the pixel includes only the capacitance (e.g., a parasitic capacitance of the organic light emitting diode). The driving current may flow through the organic light emitting diode according to a corresponding voltage.

In some example embodiments, the sensing unit 150 may measure the impedance of the pixel (or each of the pixels 111) in response to a first control signal, and may measure the driving current flowing through the pixel (or through each of the pixel 111) in response to a second control signal.

For example, the sensing unit 150 may provide a first reference voltage to a given feedback line (e.g., the (m)th feedback line Fm) in response to the first control signal, and may measure the impedance of a corresponding pixel by integrating a first current, which is fed back through the certain feedback line (e.g., Fm) according to the first reference voltage. Here, the first reference voltage may be lower than, or equal to, a threshold voltage of the organic light emitting diode (included in the pixel). For example, the sensing unit 150 may provide a second reference voltage to the certain feedback line (e.g., the (m)th feedback line Fm) in response to the second control signal, and may measure the driving current flowing through the pixel (or the driving current of the pixel) by integrating a second current, which is fed back through the certain feedback line according to the second reference voltage. Here, the second reference voltage may be higher than, or equal to, the threshold voltage of the organic light emitting diode (included in the pixel). A configuration of the sensing unit 150 and a configuration for measuring the impedance of the pixel or the driving current will be described in further detail with reference to FIGS. 3 through 4B.

The timing controller 160 may control the scan driver 120, the data driver 130, the sensing control line driving unit 140, and the sensing unit 150. The timing controller 160 may generate the scan driving control signal SCS, the data driving control signal DCS, the sensing control line driving control signal SCCS, and the sensing control signal CS, and may control the scan driver 120, the data driver 130, the sensing control line driving unit 140, and the sensing unit 150 based on respective ones of the generated signals.

In some example embodiments, the timing controller 160 may selectively generate the first control signal and the second control signal (or may generate one of the first control signal and the second control signal) based on a driving condition of the display device 100. Here, the first control signal may be used to measure the impedance of the pixel (or each of the pixels 111), and the second control signal may be used to measure the driving current flowing through the pixel (or each of the pixels 111). That is, the timing controller 160 may selectively measure the impedance of the pixel, or the driving current flowing through the pixel, based on the driving condition of the display panel 110.

In some example embodiments, the timing controller 160 may selectively generate the first control signal and the second control signal based on an aging time of the display panel 110 (e.g., an amount of time during which the display panel 110 has been on). Here, an aging may correspond to preserving the display panel 110 until an electronic characteristic (e.g., a current-voltage ("IN") characteristic) of a pixel, which is operated to be applied stress, is stabilized, or an aging may correspond to applying (or providing) stress to the display panel 110 to stabilize the electronic characteristic of the pixel. For example, the timing controller 160 may determine whether or not the aging time of the pixel exceeds a certain time (or a reference time), may generate the first control signal when the aging time is less than the certain time, and may generate the second control signal when the aging time is greater than the certain time.

In some example embodiments, the timing controller 160 may selectively generate the first control signal and the second control signal based on input data (e.g., first data DATA1). Here, the input data may have a grayscale value that corresponds to a pixel. For example, the timing controller 160 may determine whether or not the input data (or the grayscale value corresponding to the pixel) exceeds a certain grayscale value (or a reference grayscale value), may generate the first control signal when the input data is less than the certain grayscale value, and may generate the second control signal when the input data is greater than the certain grayscale value.

In some example embodiments, the timing controller 160 may calculate an amount of pixel degradation (or a degradation amount of a pixel) based on one of a measured impedance or a measured driving current. For example, the timing controller 160 may calculate an impedance variation (or a variation of the impedance, a change of the impedance) based on the measured impedance, and may obtain the amount of pixel degradation corresponding to the impedance variation using a first degradation curve. Here, the first degradation curve may represent (or include) a correlation between the impedance variation and the amount of pixel degradation. In addition, the timing controller 160 may store the measured impedance in a memory device, and may calculate the impedance variation based on a first impedance, which is stored at a prior time, and a second impedance (or the measured impedance), which is measured at a present time.

For example, the timing controller 160 may calculate a current variation (or a variation of a current, a change of a current) based on the measured driving current, and may obtain the amount of pixel degradation corresponding to the current variation using a second degradation curve. Here, the second degradation curve may represent (or include) a correlation between the current variation and the amount of pixel degradation.

In embodiments of the present invention, the display device 100 may include a power supply (or power supplier). The power supply may generate a driving voltage to drive the display device 100. The driving voltage may include a first power voltage ELVDD and a second power voltage ELVSS. The first power voltage ELVDD may be greater (or higher) than the second power voltage ELVSS.

As described above, the display device 100 may measure one of the impedance of the pixel and the driving current flowing through the pixel (or the driving current of the pixel) based on a driving condition of the display device 100 (e.g., based on the aging time of the display panel 110 or the input data), and may calculate the amount of pixel degradation based on the impedance of the pixel and/or the driving current. For example, the display device 100 may calculate the amount of pixel degradation based on the impedance variation of the pixel, as opposed to the current variation when stress applied to the display device 100 is relatively low (or at an initial time) or when the grayscale value of the input data is relatively low (or the input data has a low grayscale value). Therefore, the display device 100 may correctly compensate the pixel degradation (or may improve accuracy of degradation compensation).

It is illustrated in FIG. 1 that the display device 100 includes the sensing control line driving unit 140. However, the display device 100 is not limited thereto. For example, the sensing control line driving unit 140 may be included in the timing controller 160 or in the sensing unit 150.

It is illustrated in FIG. 1 that the display panel 110 includes the feedback lines F1 through Fm, and that the sensing unit 150 is electrically connected to the feedback lines F1 through Fm. However, the display panel 110 is not limited thereto. For example, the display panel 110 may omit the feedback lines F1 through Fm, and may use the data lines D1 through Dm as the feedback lines F1 through Fm by time-division driving.

Figure 2:
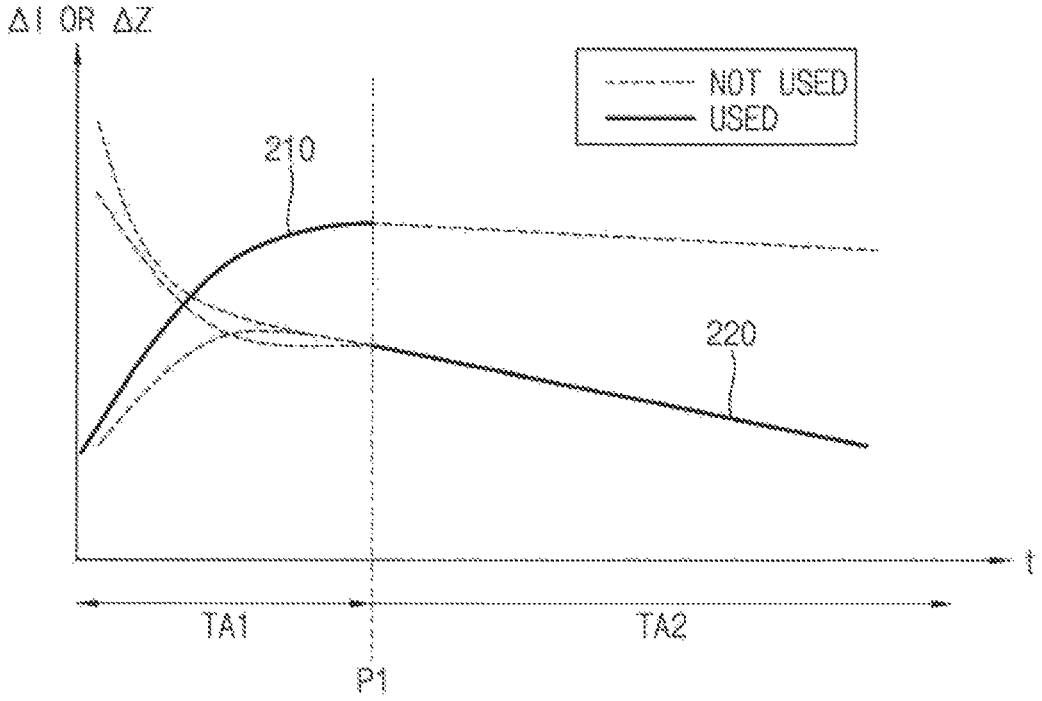
FIG. 2 is a diagram illustrating a characteristic curve of a pixel included in the display device of FIG. 1.

FIG. 2 is a diagram illustrating a characteristic curve of a pixel included in the display device of FIG. 1.

Referring to FIG. 2, a horizontal axis may represent an aging time, and a vertical axis may represent a current variation ΔI (or a variation of a driving current flowing through a pixel) or an impedance variation ΔZ (or a variation of an impedance of a pixel). The impedance variation ΔZ of the pixel may increase over time in a first period TA1 according to an impedance characteristic curve 210 of the pixel, and may decrease over time in a second period TA2. Here, the first period TA1 and the second period TA2 may be divided with respect to a certain aging time P1 (or with respect to a certain aging time point, a reference aging time).

The current variation ΔI of the pixel may be changed with suitable various shapes in the first period TA1 according to a current characteristic curve 220 (e.g., a characteristic curve representing a current of the pixel (or a current variation of the pixel) corresponding to a certain voltage), and may linearly decrease in the second period TA2. That is, the current variation ΔI may appear differently for each display device in the first period TA1 according to an aging condition (or aging time). Therefore, in the first period TA1, it is difficult to standardize current characteristic curves, which have different shapes, into the current characteristic curve 220, which represents a current variation ΔI of the pixel. Even if the current characteristic curves are standardized into the current characteristic curve 220, the current characteristic curve 220 may have a large deviation compared to the current characteristic curves. Therefore, compensating the pixel degradation based on the current characteristic curve 220 may be performed inaccurately.

The display device 100 according to example embodiments may compensate the pixel degradation by using the impedance characteristic curve 210 in the first period TA1, and by using the current characteristic curve 220 in the second period TA2. Therefore, the display device 100 may improve accuracy of degradation compensation.

In some example embodiments, the aging time P1 (or a reference aging time) may have a constant value, and may be pre-determined. For example, the aging time P1 may be hundreds of hours. For example, the aging time P1 may be a feature point of the impedance characteristic curve 210. For example, the impedance variation ΔZ of the pixel may be saturated. Here, the aging time P1 may be a saturation time point of the impedance variation ΔZ of the pixel (e.g., a time point at which a sign of a tangential gradient of the impedance variation ΔZ is changed, or a time point at which a magnitude of the tangential gradient of the impedance variation ΔZ is within a certain value).

Figure 3:
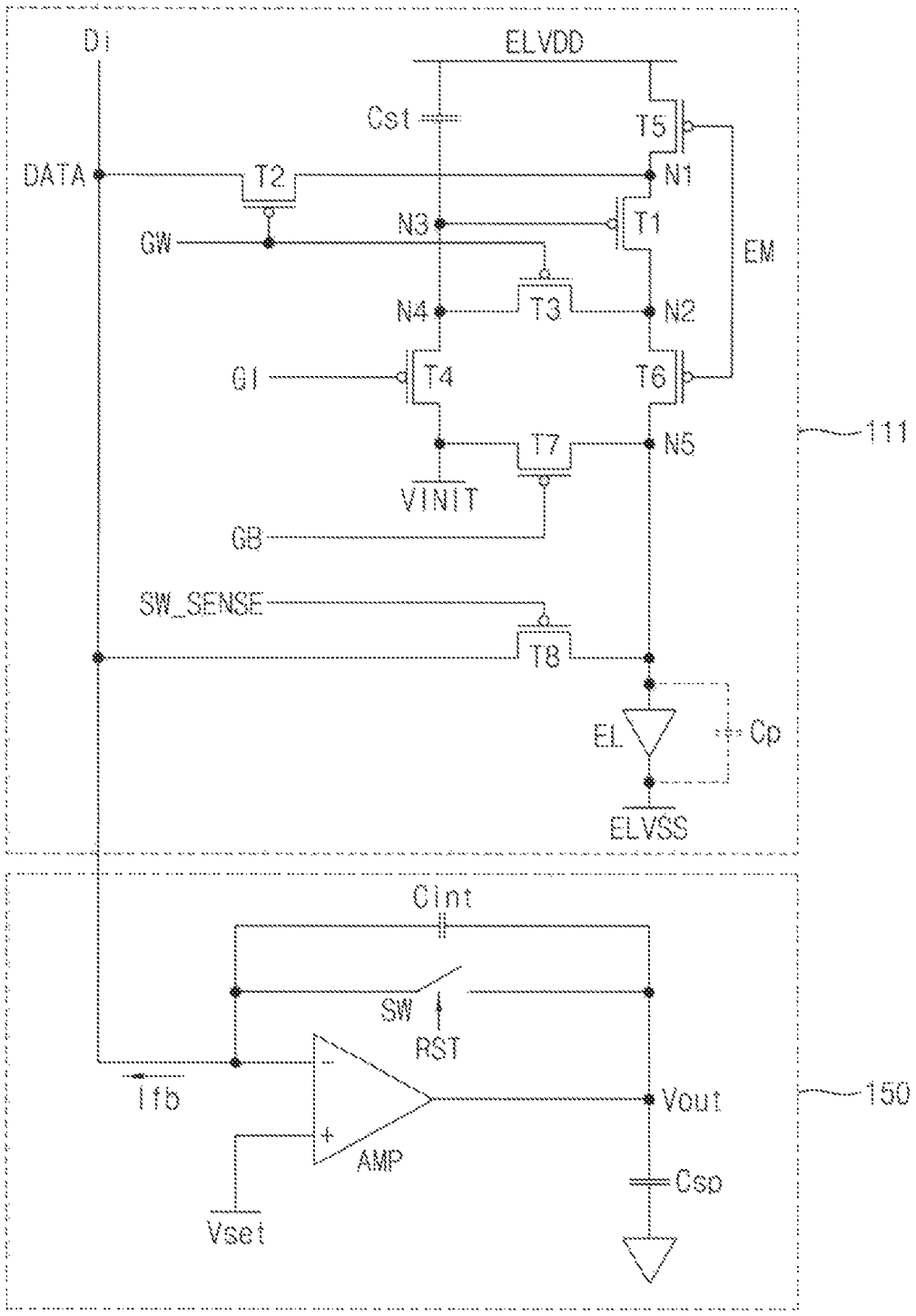
FIG. 3 is a circuit diagram illustrating examples of a pixel and a sensor included in the display device of FIG. 1.

FIG. 3 is a circuit diagram illustrating examples of a pixel 111 and a sensing unit 150 included in the display device of FIG. 1.

Referring to FIG. 3, the pixel 111 may have a structure of 8T1C (i.e., a structure having eight transistors and one capacitor). The pixel 111 may include first through eighth transistors T1 through T8, a storage capacitor Cst, and an organic light emitting diode EL. The pixel 111 may be electrically connected to a data line Di (or a feedback line) through the sensing unit 150.

The first transistor T1 (or a driving transistor) may be electrically connected between a high power voltage ELVDD supply and the organic light emitting diode EL (or may be between a first node N1 and a second node N2), and may be turned on in response to a first node voltage at the first node N1.

The second transistor T2 (or a switching transistor) may be electrically connected between the data line Di and the first node N1, and may be turned on in response a first gate signal GW (or a first scan signal).

The third transistor T3 may be electrically connected between the second node N2 and a third node N3, and may be turned on by the first gate signal GW. That is, the second transistor T2 and the third transistor T3 may transfer a data signal DATA to the third node N3 in response to the first gate signal GW. The storage capacitor Cst may be electrically connected between the high power voltage ELVDD supply and the third node N3, and may store the data signal DATA provided to the third node N3.

The fourth transistor T4 may be electrically connected between a fourth node N4 and an initialization voltage VINT supply, and may be turned on in response to a second gate signal GI (or a second scan signal). Here, the storage capacitor Cst may be initialized to charge (or have) the initialization voltage VINT.

The fifth transistor T5 may be electrically connected between the high power voltage ELVDD supply and the first node N1, and may be turned on in response to a light emission control signal EM.

The sixth transistor T6 may be electrically connected between the second node N2 and a fifth node N5, and may be turned on in response to the light emission control signal EM. That is, the fifth transistor T5 and the sixth transistor T6 may form a current path from the high power voltage ELVDD supply to the organic light emitting diode EL in response to the light emission control signal EM.

The organic light emitting diode EL may be electrically connected between the fifth node N5 and a low power voltage ELVSS supply. That is, an anode of the organic light emitting diode EL may be electrically connected to the fifth node N5, and a cathode of the organic light emitting diode EL may be electrically connected to the low power voltage ELVSS supply. The organic light emitting diode EL may emit light based on a current (i.e., a driving current) transferred through the first transistor T1. The organic light emitting diode EL may include a capacitance, and the capacitance may be represented as a parasitic capacitor Cp electrically connected in parallel to the organic light emitting diode EL, as illustrated in FIG. 3.

The seventh transistor T7 may be electrically connected between the initialization voltage VINT supply and the fifth node N5, and may be turned on in response to a third gate signal GB (or third scan signal). That is, the seventh transistor T7 may form a bypass route (or a bypass path) between the fifth node N5 and the initialization voltage VINT supply in response to the third gate signal GB.

The eighth transistor T8 (or a sensing transistor) may be electrically connected between the fifth node N5 and the data line Di, and may be turned on in response to a sensing control signal SW_SENSE. That is, the eighth transistor T8 may be electrically connected between the anode of the organic light emitting diode EL and the data line Di, and may couple (or connect) the anode of the organic light emitting diode EL and the data line Di in response to the sensing control signal SW_SENSE. Here, the sensing control signal SW_SENSE may be provided from the sensing control line driving unit 140 (or the timing controller 160) to the eighth transistor T8.

The pixel 111 is illustratively shown in FIG. 2; however, the pixel 111 is not limited thereto. For example, the pixel 111 may have a structure of 4T1C (i.e., a structure having four transistors and one capacitor). For example, the pixel 111 may include the data line Di and a feedback line, and the eighth transistor T8 may be electrically connected between the feedback line and the organic light emitting diode EL. Each of the first through eighth transistors T1 through T8 is a P-type transistor in the present embodiment; however, the first through eighth transistors T1 through T8 are not limited thereto. For example, the first through eighth transistors T1 through T8 may each be an N-type transistor.

The sensing unit 150 may include an amplifier AMP, an integration capacitor Cint, and a switch SW. The amplifier AMP may include a first input terminal electrically connected to the data line Di (or electrically connected to a feedback line), a second input terminal for receiving a reference voltage Vset, and an output terminal.

The integration capacitor Cint may be electrically connected between the first input terminal of the amplifier AMP and the output terminal of the amplifier AMP. When the eighth transistor T8 is turned on, a current path may be formed from the amplifier AMP through the data line Di to the organic light emitting diode EL. Here, a feedback current Ifb may flow from the output terminal of the amplifier AMP through the integration capacitor Cint and the data line Di according to the reference voltage Vset, and the integration capacitor Cint may integrate the feedback current Ifb. The sensing unit 150 may temporally store an integrated feedback current (e.g., a measured voltage Vout) using a sampling capacitor Csp.

The sensing unit 150 may generate an impedance of the pixel 111 or a driving current of the pixel 111 (or an information of an impedance of the pixel 111 or an information of a driving current of the pixel 111) based on the integrated feedback current (e.g., the measured voltage Vout), or the sensing unit 150 may provide the integrated feedback current (e.g., the measured voltage Vout) to the timing controller 160. For example, the sensing unit 150 may output a measured impedance of the pixel 111, or may output a measured driving current of the pixel 111, by processing the integrated feedback current (e.g., the measured voltage Vout) using a comparator, an analog-digital convertor ("ADC"), and/or the like. For example, the sensing unit 150 may provide the measured voltage Vout to the timing controller 160, and the timing controller 160 may generate the measured impedance of the pixel 111 or the measured driving current of the pixel 111 by processing the measured voltage Vout.

The switch SW may be electrically connected in parallel to the integration capacitor Cint, and may be turned on (or be turned off) in response to a switch control signal RST. When the switch SW is turned on, the feedback current Ifb flows through a current path formed by the switch SW. Therefore, a voltage across the integration capacitor Cint may have about 0 volts (V), and the integration capacitor Cint may be discharged (or be initialized).

Figure 4A:
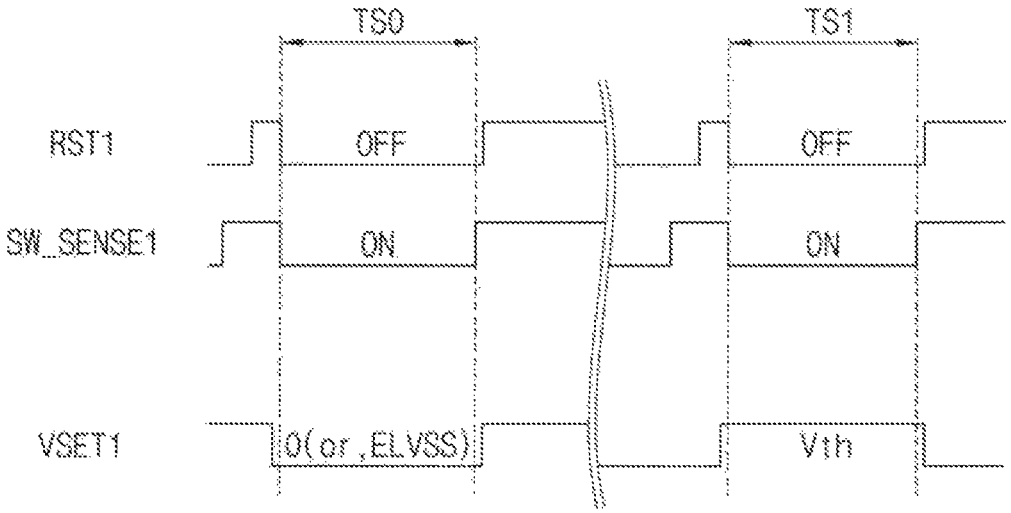
FIG. 4A is a waveform diagram illustrating an example of a first control signal generated by the timing controller included in the display device of FIG. 1.
Figure 4B:
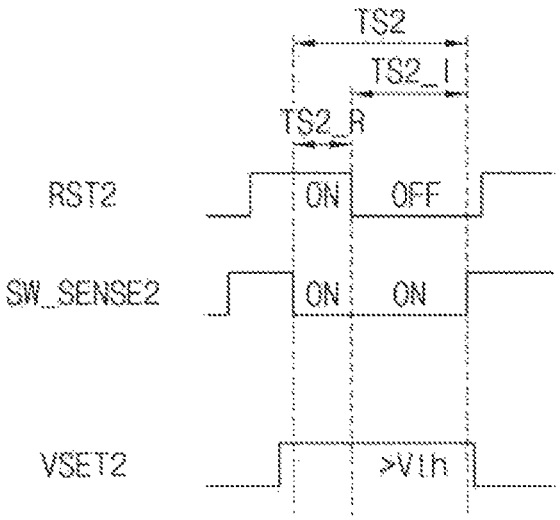
FIG. 4B is a waveform diagram illustrating an example of a second control signal generated by the timing controller included in the display device of FIG. 1.

FIG. 4A is a waveform diagram illustrating an example of a first control signal generated by the timing controller included in the display device of FIG. 1. FIG. 4B is a waveform diagram illustrating an example of a second control signal generated by the timing controller included in the display device of FIG. 1.

Referring to FIGS. 3 and 4A, a first control signal may include a first sensing control signal SW_SENSE1 and a first switch control signal RST1. For reference, the sensing control signal SW_SENSE described with reference to FIG. 3 may be used to control the eighth transistor T8 (or the sensing transistor) included in the pixel 111, and the first sensing control signal SW_SENSE1 may be the sensing control signal SW_SENSE corresponding to a first sensing period TS1. The switch control signal RST described with reference to FIG. 3 may be used to control the switch SW included in the sensing unit 150, and the first switch control signal RST1 may be the switch control signal RST corresponding to the first sensing period TS1. The first sensing period TS1 may be allocated for measuring the impedance of the pixel 111.

As illustrated in FIG. 4A, the first sensing period TS1 may further include, or may be preceded by, a ready period TS0. Here, the ready period TS0 may be for initializing the pixel 111 and the sensing unit 150.

In the ready period TS0, the first switch control signal RST1 may have a second turn-off voltage (e.g., a voltage to turn the switch SW off, or a logic low level), and the first sensing control signal SW_SENSE1 may have a first turn-on voltage (e.g., a voltage to turn the eighth transistor T8 on, or a logic low level). A first reference voltage VSET1 may be equal to about 0 volts (V) (or may be a voltage that is equal to the low power voltage ELVSS). Here, the reference voltage described with reference to FIG. 3 may be a voltage provided to the second input terminal of the amplifier AMP, and the first reference voltage VSET1 may be a reference voltage corresponding to the first sensing period TS1.

In this case, the eighth transistor T8 may be turned on, and a voltage at the anode of the organic light emitting diode EL may be equal to a voltage at the second input terminal of the amplifier AMP (i.e., about 0 volts (V)). Therefore, a voltage across the organic light emitting diode EL may be about 0 volts (V), and a parasitic capacitor Cp of the organic light emitting diode EL may be discharged (or may be initialized).

That is, in the ready period TS0, the sensing unit 150 may discharge the parasitic capacitor Cp of the organic light emitting diode EL by providing the first reference voltage VSET1 having about 0 volts (V) to the data line Di (or to a feedback line).

In the first sensing period TS1, the first switch control signal RST1 may have the second turn-off voltage, and the first sensing control signal SW_SENSE1 may have the first turn-on voltage. The first reference voltage VSET1 may be equal to, or less than, a threshold voltage Vth of the organic light emitting diode EL.

In this case, the eighth transistor T8 may be turned on, and a voltage at the anode of the organic light emitting diode EL may be equal to the first reference voltage VSET1 (e.g., a threshold voltage Vth of the organic light emitting diode EL). Because a voltage across the organic light emitting diode EL may be equal to the threshold voltage Vth, the organic light emitting diode EL may not emit light, and the parasitic capacitor Cp of the organic light emitting diode EL may be charged corresponding to the threshold voltage Vth.

The integration capacitor Cint of the sensing unit 150 may be charged with an amount of charge that is equal to an amount of charge charged in the parasitic capacitor Cp of the organic light emitting diode EL. Therefore, the sensing unit 150 may measure the impedance of the pixel 111 based on an output voltage Vout of the amplifier AMP.

Referring to FIGS. 3 and 4B, the second control signal may include a second sensing control signal SW_SENSE2 and a second switch control signal RST2. Here, the second sensing control signal SW_SENSE2 may be a sensing control signal corresponding to a second sensing period TS2, and the second switch control signal RST2 may be a switch control signal corresponding to the second sensing period TS2. The second sensing period TS2 may be for measuring the driving current of the pixel 111 (or the driving current flowing through the pixel 111).

As illustrated in FIG. 4B, the second sensing period TS2 may include a reset period TS2_R and an integration period TS2_I. The second switch control signal RST2 may have a second turn-on voltage (i.e., a voltage to turn the switch SW on, or a logic high level) in the reset period TS2_R of the sensing period TS2, and may have the second turn-off voltage in the integration period TS2_I of the second sensing period TS2. The second sensing control signal SW_SENSE2 may have the first turn-on voltage in the second sensing period TS2. A second reference voltage VSET2 may be greater (or higher) than the threshold voltage Vth of the organic light emitting diode EL. Here, the second reference voltage VSET2 may be a reference voltage VSET corresponding to the second sensing period TS2.

In the reset period TS2_R, the eighth transistor T8 may be turned on, and a voltage at the anode of the organic light emitting diode EL may be equal to the second reference voltage VSET (e.g., equal to a voltage greater than the threshold voltage Vth of the organic light emitting diode EL). Because a voltage across the organic light emitting diode EL is greater than the threshold voltage Vth of the organic light emitting diode EL, the driving current may flow through the organic light emitting diode EL, and the parasitic capacitor Cp of the organic light emitting diode EL may be charged corresponding to the threshold voltage Vth of the organic light emitting diode EL.

Though the switch SW is turned on, the integration capacitor Cint may not be charged (or may be charged with no charge). That is, a charge (or information) corresponding to the impedance of the pixel 111 (or the parasitic capacitor Cp of the organic light emitting diode EL) may be removed (or cleared).

In the integration period TS2_I, the driving current may flow through the organic light emitting diode EL. Because the switch SW is turned on, the integration capacitor Cint of the sensing unit 150 may be charged corresponding to the driving current. Therefore, the sensing unit 150 may measure the driving current of the pixel 111 based on an output voltage Vout of the amplifier AMP.

As described above, the sensing unit 150 may measure the impedance of the pixel 111 in the first sensing period TS1, and may measure the driving current of the pixel in the second sensing period TS2.

Figure 5:
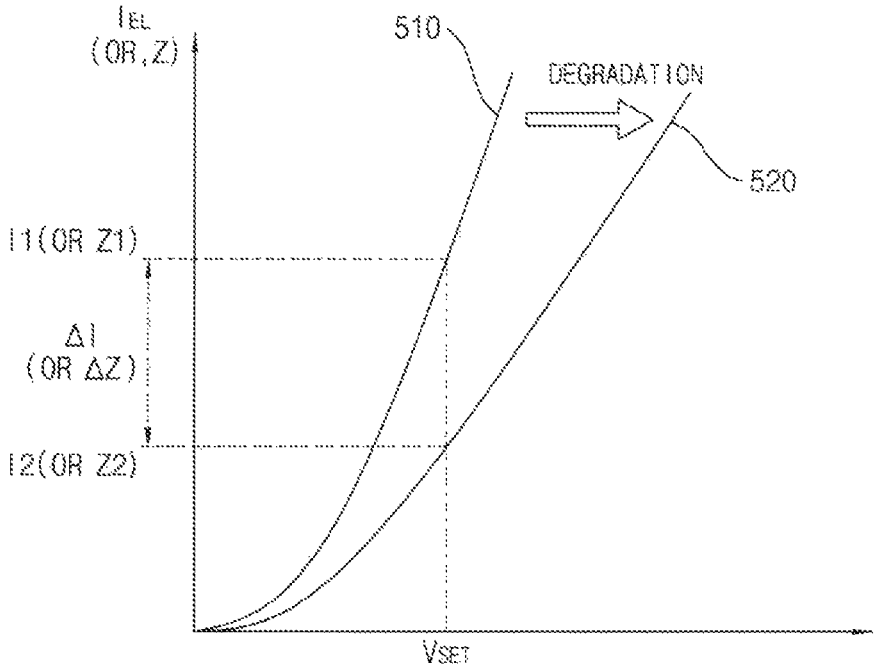
FIG. 5 is a diagram illustrating an example of a characteristic curve of a pixel included in the display device of FIG. 1.

FIG. 5 is a diagram illustrating an example of a characteristic curve of a pixel included in the display device of FIG. 1.

Referring to FIGS. 1 and 5, a first characteristic curve 510 of the pixel 111 may be a current-voltage characteristic curve (or an impedance-voltage characteristic curve), which is pre-modeled, and a second characteristic curve 520 may be a current-voltage characteristic curve (or an impedance-voltage characteristic curve) of the pixel 111 that is degraded (e.g., a degraded pixel).

According to the first characteristic curve 510, the display device 100 may measure a first driving current I1 (or a first impedance Z1) corresponding to the reference voltage Vset. That is, the display device 100 may provide the reference voltage Vset to the pixel 111, and may measure the first driving current I1 (or the first impedance Z1) by using the sensing unit 150. The display device 100 may generate (or model) the first characteristic curve 510 based on the reference voltage Vset and the first driving current I1 (or the first impedance Z1).

According to the second characteristic curve 520, the display device 100 may measure a second driving current I2 (or a second impedance Z2) corresponding to the reference voltage Vset. That is, the display device 100 may provide the reference voltage Vset to the pixel that is degraded, and may measure the second driving current (or the second impedance Z2) by using the sensing unit 150.

The display device 100 (or the timing controller 160) may calculate an amount of pixel degradation based on the first driving current I1 (or the first impedance Z1) and the second driving current I2 (or the second impedance Z2). For example, the display device 100 may calculate a current difference ΔI between the first driving current I1 and the second driving current I2, and may then calculate the amount of pixel degradation using Equation 1 below.

$$\Delta E=\alpha*\Delta I+\beta \quad \text{(Equation 1)}$$

where ΔE denotes the amount of pixel degradation, a denotes a constant, ΔI denotes the current difference, and β denotes a constant.

The display device 100 may compensate input data (e.g., the first data DATA1 of FIG. 1) based on the amount of pixel degradation. For example, the display device 100 may obtain compensation data corresponding to the amount of pixel degradation from a memory device (or a look-up table), and may compensate the input data by summing the input data and the compensation data.

Similarly, the display device 100 may calculate the amount of pixel degradation based on the first impedance Z1 and the second impedance Z2, and may compensate the input data (e.g., the first data DATA1) based on the amount of pixel degradation.

As described with reference to FIG. 5, the display device 100 may calculate the amount of pixel degradation based on a measured driving current (e.g., the driving current of the pixel 111) or a measured impedance (e.g., the impedance of the pixel 111), and may compensate the input data based on the amount of pixel degradation.

Figure 6:
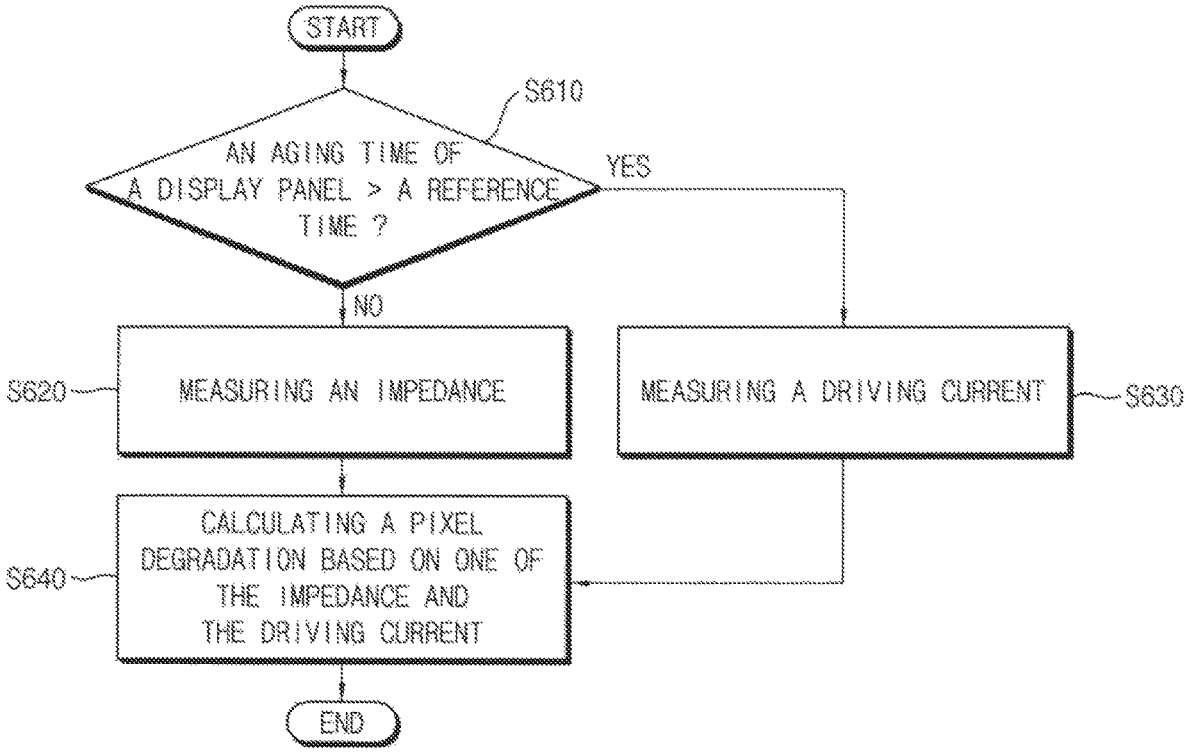
FIG. 6 is a flow diagram illustrating a method of compensating degradation according to example embodiments of the present inventive concept.

FIG. 6 is a flow diagram illustrating a method of compensating degradation according to example embodiments of the present inventive concept. The method of FIG. 6 may be performed by the display device 100 of FIG. 1.

Referring to FIGS. 1 and 6, the method of FIG. 6 may determine whether or not an aging time of the display panel 110 exceeds a reference time (S610). That is, the method of FIG. 6 may determine whether or not a current-voltage characteristic of the pixel 111 is stable based on the aging time of the display panel 110.

The method of FIG. 6 may measure an impedance of the pixel 111 when the aging time is less than, or equal to, the reference time (S620). That is, the method of FIG. 6 may determine that the current-voltage characteristic of the pixel 111 is unstable when the aging time of the display panel 110 does not exceed the reference time, and may measure the impedance of the pixel 111 to perform a degradation compensation (or to compensate the pixel degradation) based on an impedance-voltage characteristic of the pixel 111.

The method of FIG. 6 may measure a driving current of the pixel 111 when the aging time of the display panel 110 is greater than (or exceeds) the reference time (S630). That is, the method of FIG. 6 may determine that the current-voltage characteristic of the pixel 111 is stable when the aging time of the display panel 110 exceeds the reference time, and may measure the driving current of the pixel 111 to perform a degradation compensation (or to compensate the pixel degradation) based on the current-voltage characteristic of the pixel 111.

The method of FIG. 6 may calculate an amount of pixel degradation based on one of a measured impedance and a measured driving current (S640). That is, because the method of FIG. 6 selectively measures the impedance and the driving current, the method of FIG. 6 may calculate the amount of pixel degradation based on the measured signal. For example, the method of FIG. 6 may calculate an impedance variation (e.g., a difference between an initial impedance and the measured impedance) based on the measured impedance, and may obtain the amount of pixel degradation corresponding to the impedance variation using a first degradation curve. Here, the first degradation curve may represent (or include) a correlation between the impedance variation and the amount of pixel degradation, and the first degradation curve may be stored in a memory device.

The method of FIG. 6 may compensate the pixel degradation based on the amount of pixel degradation, which is calculated. For example, the method of FIG. 6 may obtain compensation data corresponding to the amount of pixel degradation from a look-up table, and may compensate the input data (or a grayscale value) corresponding to the pixel 111 based on the compensation data.

As described above, the method of FIG. 6 may measure one of the impedance of the pixel 111 and the driving current of the pixel 111 based on the aging time of the display panel 110, and may calculate the amount of pixel degradation based on the one of the of the impedance of the pixel 111 and the driving current of the pixel 111. For example, the method of FIG. 6 may calculate the amount of pixel degradation based on the impedance variation of the pixel, as opposed to the current variation of the pixel 111 when stress applied to the display device 100 is relatively low (e.g., at an initial state of the display device 100). Therefore, the method of FIG. 6 may improve accuracy of degradation compensation (or may accurately compensate the pixel degradation).

Figure 7:
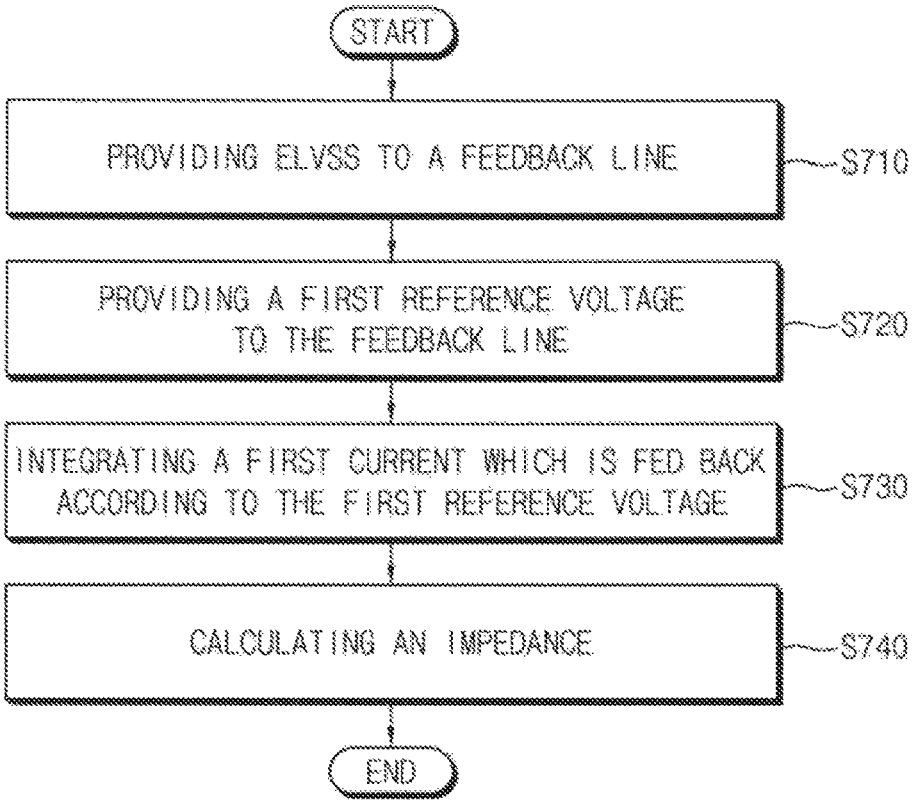
FIG. 7 is a flow diagram illustrating an example embodiment in which an impedance of a pixel is measured by the method of FIG. 6.

FIG. 7 is a flow diagram illustrating an example embodiment in which an impedance of a pixel is measured by the method of FIG. 6.

Referring to FIGS. 1, 6, and 7, the method of FIG. 7 may include a ready process to measure the impedance of the pixel 111. For example, the method of FIG. 7 may provide the low power voltage ELVSS to a feedback line that is electrically connected to the pixel (or that is electrically connected to an anode of the organic light emitting diode included in the pixel 111) (S710). In this case, a voltage across the organic light emitting diode EL included in the pixel 111 described with reference to FIG. 3 may be about 0 volts (V), and a parasitic capacitor Cp of the organic light emitting diode EL may be discharged (or may be initialized). As described with reference to FIG. 1, the impedance of the pixel 111 may be, or may correspond to, the impedance of the organic light emitting diode included in the pixel 111, and may include a resistance and a capacitance (e.g., a parasitic capacitor Cp of the organic light emitting diode). Because the resistance is significantly less than the impedance, the resistance may be irrelevant to the impedance of the pixel. Therefore, the method of FIG. 7 may initialize the impedance of the pixel 111 by providing the low power voltage ELVSS to the feedback line.

The method of FIG. 7 may provide a first reference voltage Vset1 to the feedback line (S720). Here, the first reference voltage Vset1 may be equal to, or greater than, a threshold voltage Vth of the organic light emitting diode. Because a voltage across the organic light emitting diode is equal to the threshold voltage of the organic light emitting diode, the organic light emitting diode may emit no light, and the parasitic capacitor Cp of the organic light emitting diode may be charged corresponding to the threshold voltage Vth of the organic light emitting diode.

The method of FIG. 7 may integrate a first current that is fed back through the feedback line according to the first reference voltage Vset1 (S730), and may calculate the impedance of the pixel 111 based on an integrated first current (S740). As described with reference to FIG. 4A, the first current may flow through the feedback line to the organic light emitting diode EL according to charging the parasitic capacitor Cp, and the method of FIG. 7 may calculate the impedance of the pixel 111 (e.g., capacitance of the parasitic capacitor Cp) based on the first current.

Figure 8:
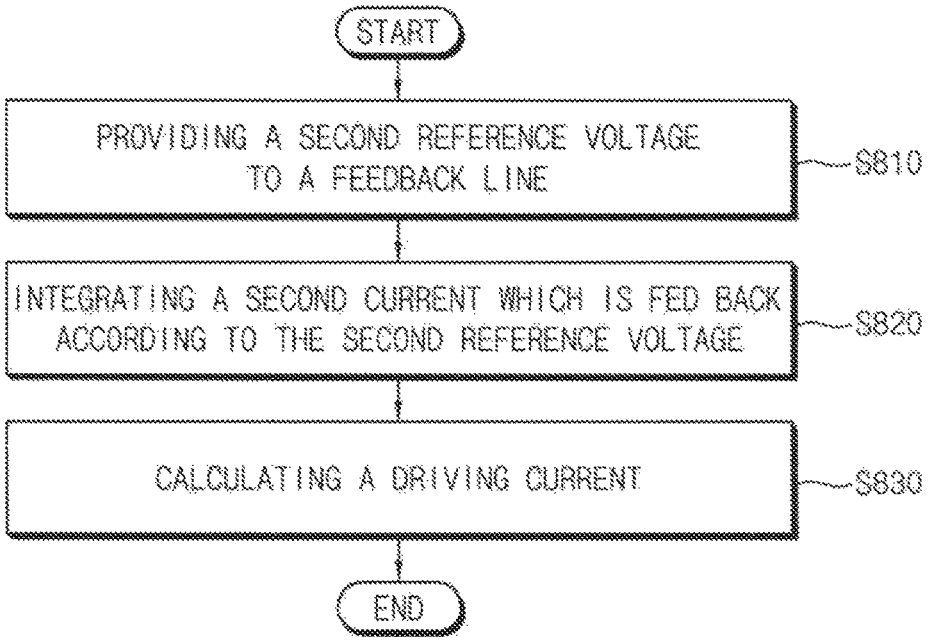
FIG. 8 is a flow diagram illustrating an example embodiment in which a driving current flowing through a pixel is measured by the method of FIG. 6.

FIG. 8 is a flow diagram illustrating an example embodiment in which a driving current flowing through a pixel is measured by the method of FIG. 6.

Referring to FIGS. 1, 6, and 8, the method of FIG. 8 may provide a second reference voltage Vset2 to the feedback line (S810). Here, the second reference voltage Vset2 may be greater than the threshold voltage Vth of the organic light emitting diode EL. Because a voltage across the organic light emitting diode EL is greater than the threshold voltage Vth of the organic light emitting diode EL, a second current may flow through the organic light emitting diode EL.

The method of FIG. 8 may integrate the second current, which is fed back through the feedback line according to the second reference voltage Vset2 (S820), and may calculate the driving current of the pixel based on an integrated second current (S830). That is, as described with reference to FIG. 4B, the second current may flow through the feedback line to the organic light emitting diode EL according to an operation of the organic light emitting diode EL, and the method of FIG. 8 may calculate the driving current of the pixel (or may calculate a current that flows through the organic light emitting diode EL) based on the second current.

Figure 9:
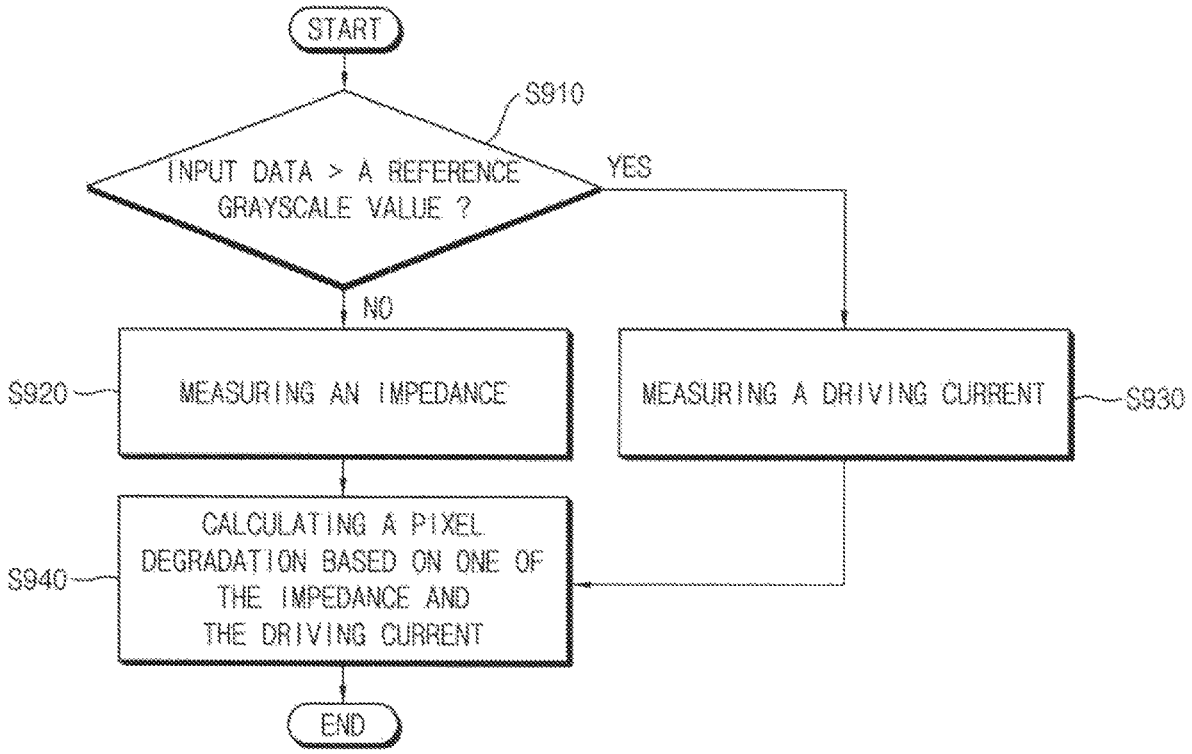
FIG. 9 is a flow diagram illustrating a method of compensating degradation according to example embodiments of the present inventive concept.

FIG. 9 is a flow diagram illustrating a method of compensating degradation according to example embodiments of the present inventive concept. The method of FIG. 9 may be performed by the display device of FIG. 1.

Referring to FIGS. 1 and 9, the method of FIG. 9 may measure one of an impedance of the pixel 111 and a driving current of the pixel 111 based on input data (e.g., first data DATA1). Here, the input data may include (or have) a grayscale value that corresponds to the pixel 111.

The method of FIG. 9 may determine whether or not the input data (or the grayscale value corresponding to the pixel 111) exceeds a certain grayscale value (or a reference grayscale value) (S910). For reference, a driving current of the pixel 111 corresponding to a low grayscale value may be less than a driving current of the pixel corresponding to other grayscale values, and may have a low signal-to-noise ("SNR"). In addition, the driving current of the pixel 111 corresponding to the low grayscale value may be not measured due to a limitation in a performance of the sensing unit 150 (or an external read-out device). Therefore, the method of FIG. 9 may determine whether or not a current-voltage characteristic of the pixel 111 is stable (or whether or not a driving current of the pixel is measurable) based on the input data.

The method of FIG. 9 may measure the impedance of the pixel 111 when the input data does not exceed the certain grayscale value (S920). That is, the method of FIG. 9 may determine that the current-voltage characteristic of the pixel 111 is unstable when the input data (or the grayscale value corresponding to the pixel 111) is less than, or equal to, the certain grayscale value, and may measure the impedance of the pixel 111 to compensate the pixel degradation based on the impedance-voltage characteristic of the pixel 111.

The method of FIG. 9 may measure the driving current of the pixel 111 when the input data is greater than, or exceeds, the certain grayscale value (S930). That is, the method of FIG. 9 may determine that the current-voltage characteristic of the pixel 111 is stable when the input data (or the grayscale value corresponding to the pixel 111) is greater than the certain grayscale value, and may measure the driving current of the pixel 111 to compensate the pixel degradation based on the current-voltage characteristic of the pixel 111.

The method of FIG. 9 may calculate an amount of pixel degradation based on one of the impedance (or a measured impedance) and the driving current (or a measured driving current) (S940). Because the method of FIG. 9 selectively measures one of the impedance and the driving current, the method of FIG. 9 may calculate the amount of pixel degradation based on a measured signal. The method of FIG. 9 may compensate the pixel degradation based on the amount of pixel degradation, which is calculated.

As described above, the method of FIG. 9 may measure one of the impedance of the pixel 111 and the driving current of the pixel 111 based on the input data, and may calculate the amount of pixel degradation based on the one of the impedance of the pixel 111 and the driving current of the pixel 111. For example, the method of FIG. 9 may calculate the amount of pixel degradation based on an impedance variation of the pixel 111 instead of a current variation of the pixel 111 when the current-voltage characteristic of the pixel is unstable (or when a low grayscale value is provided to the pixel 111). Therefore, the method of FIG. 9 may improve accuracy of degradation compensation (or may accurately compensate the pixel degradation).

The present inventive concept may be applied to any display device (e.g., an organic light emitting display device, a liquid crystal display device, and/or the like). For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, and/or the like.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer or element is referred to as being "between" two layers or elements, it can be the only layer or element between the two layers or elements, or one or more intervening layers or elements may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept."

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein, such as the scan driver 120, data driver 130, the sensing control line driving unit 140, the sensing unit 150, and the timing controller 160, may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the example embodiments of the present invention.

The foregoing is illustrative of example embodiments, and is not to be construed as limiting thereof. Although a few example embodiments have been described, those skilled in the art will readily appreciate that many suitable modifications are possible in the example embodiments without materially departing from the novel teachings of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that suitable modifications to the disclosed example embodiments, as well as other example embodiments, are intended to be included within the scope of the present inventive concept, which is defined by the following claims, and equivalents thereof.

What is claimed is:

1. A display device comprising:

a display panel comprising a pixel electrically connected to a feedback line;

a sensor electrically connected to the feedback line and the pixel, the sensor being configured to measure an impedance of the pixel in response to a first control signal, and to measure a driving current flowing through the pixel in response to a second control signal; and a timing controller configured to selectively generate the first control signal and the second control signal based on an aging time of the display panel, to determine when the aging time exceeds a reference time, to generate the first control signal when the aging time is less than the reference time, and to generate the second control signal when the aging time is greater than the reference time, wherein the reference time corresponds to a saturation time point of an impedance variation of the pixel.

2. The display device of claim 1, wherein the sensor is further configured to provide a first reference voltage to the feedback line in response to the first control signal, and to measure the impedance of the pixel by integrating a first current that is fed back through the feedback line according to the first reference voltage, and wherein the first reference voltage is lower than, or equal to, a threshold voltage of an organic light emitting diode of the pixel.

3. The display device of claim 2, wherein the sensor is further configured to discharge a parasitic capacitor of the organic light emitting diode by providing a low power voltage to the feedback line before the first reference voltage is provided to the feedback line.

4. The display device of claim 1, wherein the sensor is further configured to provide a second reference voltage to the feedback line in response to the second control signal, and to measure the driving current by integrating a second current that is fed back through the feedback line according to the second reference voltage, and wherein the second reference voltage is greater than, or equal to, a threshold voltage of an organic light emitting diode of the pixel.

5. The display device of claim 1, wherein the pixel comprises:

an organic light emitting diode comprising a cathode electrically connected to a low power voltage; and a sensing transistor electrically connected between an anode of the organic light emitting diode and the feedback line.

6. The display device of claim 5, wherein the sensor comprises:

an amplifier comprising:

a first input terminal electrically connected to the feedback line;

a second input terminal configured to receive a reference voltage; and an output terminal;

a capacitor electrically connected between the first input terminal of the amplifier and the output terminal of the amplifier; and a switch electrically connected in parallel to the capacitor, the switch being configured to be turned off based on a switch control signal.

7. The display device of claim 6, wherein the first control signal comprises a first sensing control signal to control the sensing transistor, and a first switch control signal to control the switch, wherein the first sensing control signal has a first turn-on voltage to turn on the sensing transistor in a first sensing period, and wherein the first switch control signal has a second turn-off voltage to turn off the switch in the first sensing period.

8. The display device of claim 7, wherein the second control signal comprises a second sensing control signal to control the sensing transistor, and a second switch control signal to control the switch, wherein the second sensing control signal has the first turn-on voltage in a second sensing period, wherein the second switch control signal has a second turn-on voltage to turn on the switch in a reset period, and has the second turn-off voltage in an integration period, and wherein the second sensing period comprises the reset period and the integration period.

9. The display device of claim 1, wherein the timing controller is configured to calculate an amount of pixel degradation of the pixel based on the impedance of the pixel or the driving current.

10. The display device of claim 9, wherein the timing controller is configured to calculate the impedance variation based on the impedance, and to obtain the amount of pixel degradation corresponding to the impedance variation by using a first degradation curve that represents a correlation between the impedance variation and the amount of pixel degradation.

11. A display device comprising:

a display panel comprising a pixel electrically connected to a feedback line;

a sensor electrically connected to the feedback line and the pixel, the sensor being configured to measure an impedance of the pixel in response to a first control signal, and to measure a driving current flowing through the pixel in response to a second control signal; and a timing controller configured to selectively generate the first control signal and the second control signal based on input data that comprises a grayscale value corresponding to the pixel, to determine when the input data exceeds a reference grayscale value, to generate the first control signal when the input data is less than, or equal to, the reference grayscale value, and to generate the second control signal when the input data is greater than the reference grayscale value, wherein the reference grayscale value corresponds to an unstable current-voltage characteristic of the pixel.

12. A method of compensating degradation, the method comprising:

determining when an aging time of a display panel exceeds a reference time, the display panel comprising a pixel electrically connected to a feedback line;

measuring, by a sensor coupled to the feedback line and the pixel, an impedance of the pixel when the aging time is less than the reference time; and measuring, by the sensor, a driving current flowing through the pixel when the aging time is greater than the reference time, wherein the reference time corresponds to a saturation time point of an impedance variation of the pixel.

13. The method of claim 12, wherein measuring the impedance of the pixel comprises discharging a parasitic capacitor of an organic light emitting diode of the pixel by providing a low power voltage to the feedback line.

14. The method of claim 13, wherein measuring the impedance of the pixel further comprises:

providing a first reference voltage to the feedback line; and integrating a first current that is fed back through the feedback line according to the first reference voltage, and wherein the first reference voltage is lower than, or equal to, a threshold voltage of the organic light emitting diode.

15. The method of claim 12, wherein measuring the driving current comprises:

providing a second reference voltage to the feedback line; and integrating a second current that is fed back through the feedback line according to the second reference voltage, and wherein the second reference voltage is higher than, or equal to, a threshold voltage of an organic light emitting diode of the pixel.

16. The method of claim 12, further comprising calculating an amount of pixel degradation of the pixel based on the impedance of the pixel or the driving current.

17. The method of claim 16, wherein calculating the amount of pixel degradation comprises:

calculating the impedance variation based on the impedance; and obtaining the amount of pixel degradation corresponding to the impedance variation by using a first degradation curve that represents a correlation between the impedance variation and the amount of pixel degradation.

* * * * *